US006446361B1

(12) United States Patent
Chun

(10) Patent No.: US 6,446,361 B1
(45) Date of Patent: Sep. 10, 2002

(54) TRANSFORMABLE SLIPPER TOY

(75) Inventor: Michelle Chun, Ontario (CA)

(73) Assignee: Perceptek Inc., Mississauga (CA)

( * ) Notice: Subject to any disclaimer, the term of this patent is extended or adjusted under 35 U.S.C. 154(b) by 0 days.

(21) Appl. No.: 09/799,510

(22) Filed: Mar. 7, 2001

(51) Int. Cl.[7] ..... A43B 3/24

(52) U.S. Cl. ..... 36/100; 36/112; 36/102; 36/105; 446/71; 446/72

(58) Field of Search ..... 36/100, 101, 102, 36/112, 105; 446/71, 72, 369

(56) References Cited

U.S. PATENT DOCUMENTS

D172,669 S * 7/1954 Kleppen
6,189,240 B1 * 2/2001 Cowgill et al.
6,247,730 B1 * 6/2001 Henderson et al.
6,276,074 B1 * 8/2001 Martin

* cited by examiner

*Primary Examiner*—Ted Kavanaugh
(74) *Attorney, Agent, or Firm*—Ingrid E. Schmidt

(57) ABSTRACT

A slipper having a sole and a foot covering that transforms into a toy play character by coupling the sole to the foot covering. The toy character may take the form of an animal, a human figure, or an imaginary, or abstract character, or other object. The transforming slipper toy may be made of plush material. Conveniently, the sole is coupled to the foot covering using Velcro®, button or snap fasteners, hooks, a zipper® or string. The sole may also have a pocket for receiving a heel portion of the sole whereby the sole and the foot covering are united.

10 Claims, 9 Drawing Sheets

TRANSFORMABLE SLIPPER TOY

FIELD OF THE INVENTION

This invention relates to slippers, novelty slippers and toys.

BACKGROUND OF THE INVENTION

Novelty slippers may take on the shape or part of the shape of an animal or other character. These slippers may bear the face along with floppy ears or other features of the character. Alternatively the slipper may take the body shape of the entire character and the foot of the wearer is inserted into that character body. Typically, the wearer's foot will be inserted into the back of the character's body. None of these known slippers transforms from a slipper into the character itself, thereby disguising, or partly disguising the item's function as a slipper, and making it more compact, so that the item can then be stored in that disguised form, or played with as a toy until it is once again used as a slipper.

SUMMARY OF THE INVENTION

In accordance with this invention, there is provided a transformable slipper toy having a sole and a foot covering. The slipper has coupling means for uniting an exposed heel portion of the sole with the foot covering so that a foot access in the slipper is closed. In this way, the slipper may be transformed from a first configuration where it has a foot access to a second configuration where there is none.

BRIEF DESCRIPTION OF THE DRAWINGS

A preferred embodiment of the invention and several variations thereof showing a number of coupling means for uniting a heel portion of the slipper with a foot covering for the slipper are described below with reference to the accompanying drawings, in which.

DETAILED DESCRIPTION OF PREFERRED EMBODIMENT

Figure 1:
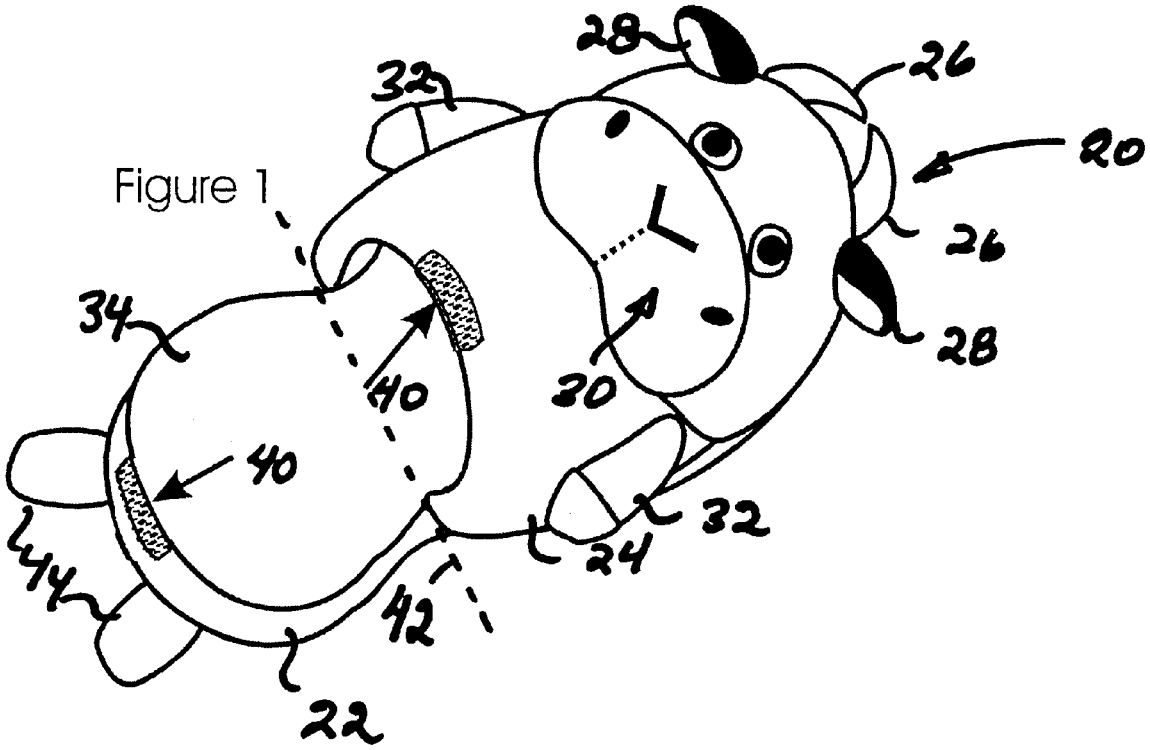
FIG. 1 is a perspective view of a slipper in accordance with the invention in an untransformed configuration.
Figure 2:
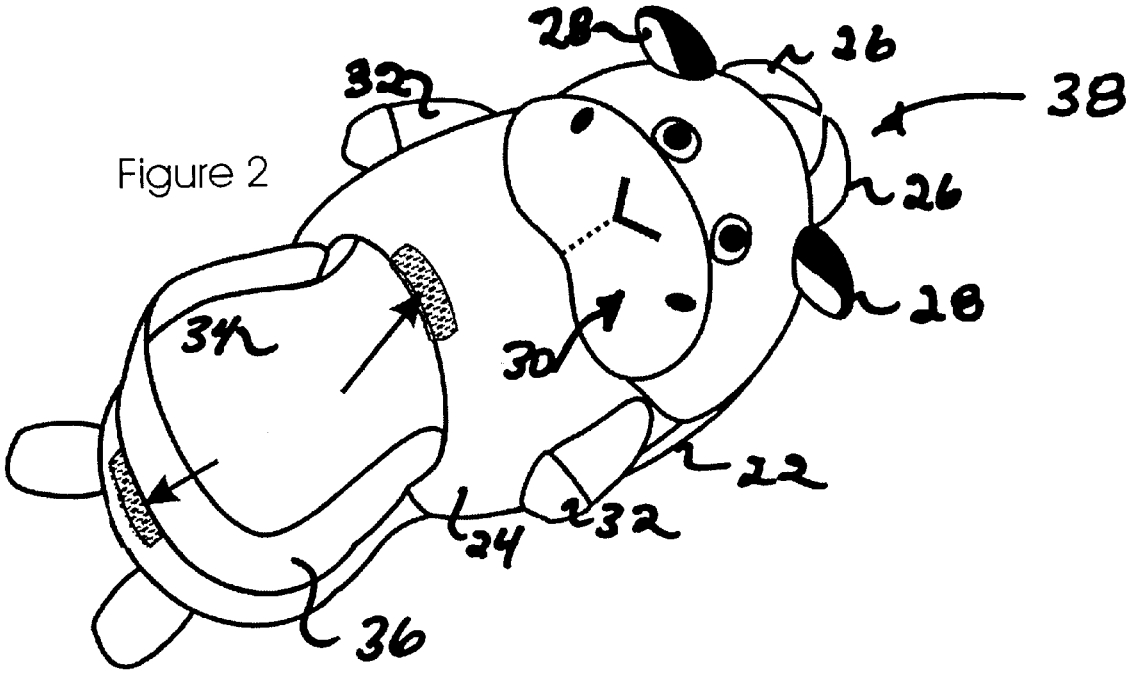
FIG. 2 is a similar view to FIG. 1 showing a different style of slipper.

A slipper in accordance with the invention is generally indicated in FIG. 1 by reference numeral 20. The slipper 20 has a sole 22 and a foot covering 24 which extends between marginal portions of the sole to cover the metatarsal portion of a foot and toes (not shown) and is a style of slipper generally referred to as a "mule". The foot covering 24 carries a number of decorative appendages for simulating a toy character and this embodiment includes a pair of horns 26, ears 28, bovine features 30 and arms 32. The appendages will preferably be made of plush material so that the slipper will have a generally cuddly appearance. A top portion of the sole is partially exposed in a heel portion indicated by reference numeral 34 and which defines a foot access to the slipper 20. While the heel portion 34 is generally open, it may be partially covered by a so called quarter 36, as seen in the slipper 38 of FIG. 2, and which would at least partially cover the-side of a person's heel. Since the slipper 38 of FIG. 2 is otherwise identical to the slipper of FIG. 1, like numerals have been used to identify like parts.

The slipper of FIG. 1 is shown in a first untransformed configuration so as to provide access to a foot. The slipper 20 may be transformed into a second configuration shown in FIG. 3 where the slipper is disguised into a character and the slipper function is not apparent. To achieve such a transformation, coupling means are provided on the slipper for uniting the heel portion 34 of the slipper with the foot covering 24. In the embodiment of FIG. 1, the coupling means comprises complementary hook and loop fastener strips 40 otherwise known as Velcro® which are attached to respective portions of the heel portion 34 and the foot covering 24. Conveniently, the hook and loop fastener strips 40 are disposed on a median for the slipper on respective marginal portions of the sole 22 and the foot covering 24 and which define an opening for receiving a foot. The sole 22 is made of a pliable material so that it may be folded on fold line 42 indicated as a dashed line in FIG. 1 before uniting the fastener strips 40.

Figure 3:
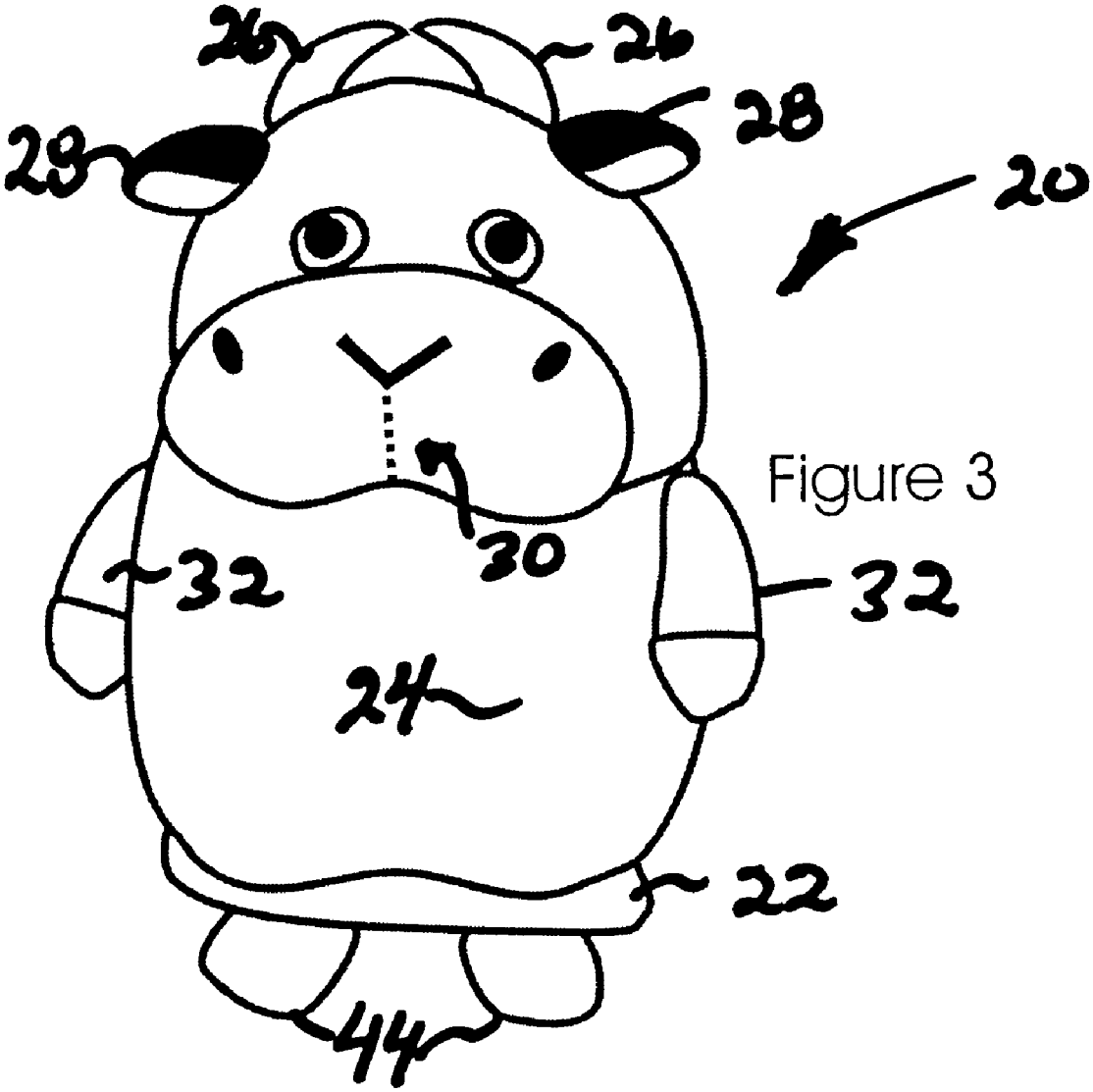
FIG. 3 is a front elevational view the slipper of FIG. 1 in a transformed configuration.

In use, the transformed slipper of FIG. 3 would be posed in an erect position such that the decorative appendages of the foot covering which otherwise are disposed horizontally are now disposed vertically for the entertainment and enjoyment of those who possess such a slipper. To encourage such orientation, the slipper 20 of FIG. 1 additionally includes a pair of foot appendages 44 which extend from the heel portion 34 of the sole 22.

It will be understood that a number of coupling means may be used for uniting the heel portion of a slipper with the associated foot covering to close the foot access and transform the slipper into the second configuration. Such variations of the coupling means are described below with reference to the remaining figures in which like parts are identified by like numerals.

Figure 4:
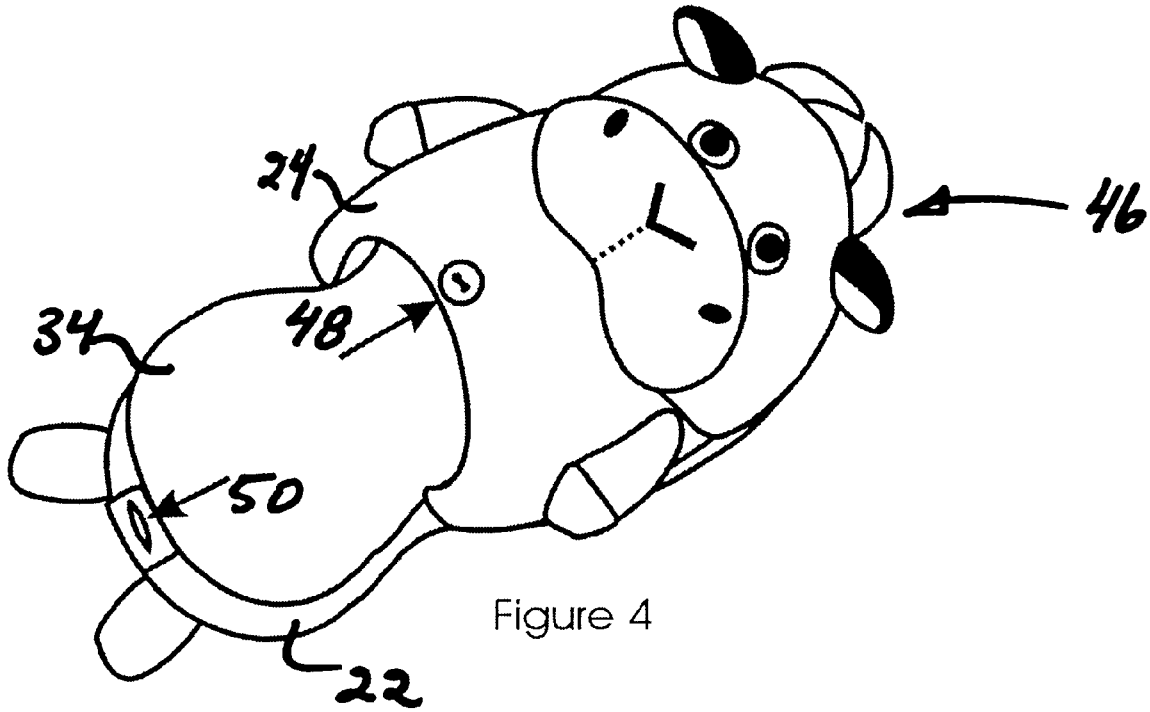
FIG. 4 is a similar to FIG. 1 showing coupling means in the form of a button and button hole.

The slipper 46 of FIG. 4 has coupling means in the form of a button 48 which has been stitched to the marginal portion of the foot covering 24 adjacent a foot receiving opening and button hole 50 disposed opposite the button 48 on a marginal portion of the sole 22.

Figure 5:
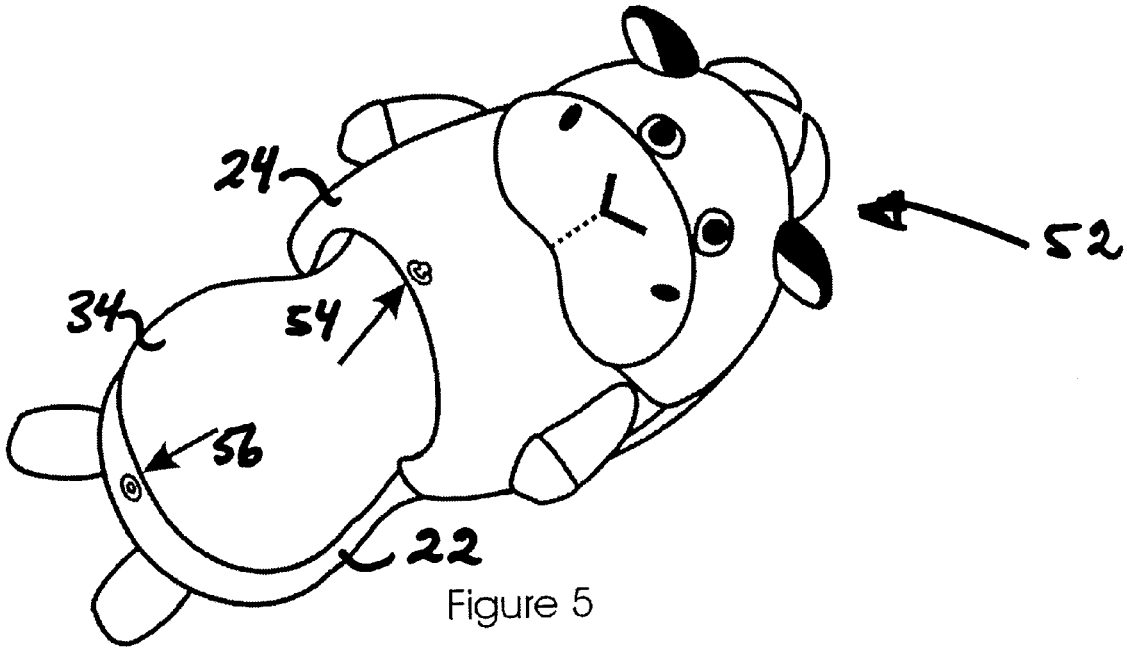
FIG. 5 is a similar view to FIG. 1 showing coupling means in the form of snap fastener assembly.

In the slipper 52 of FIG. 5, the coupling means is in the form of a snap fastener assembly and comprises a snap portion 54 fastened to the foot covering 24 and snap receiving portion 56 fastened to the sole 22.

Figure 6:
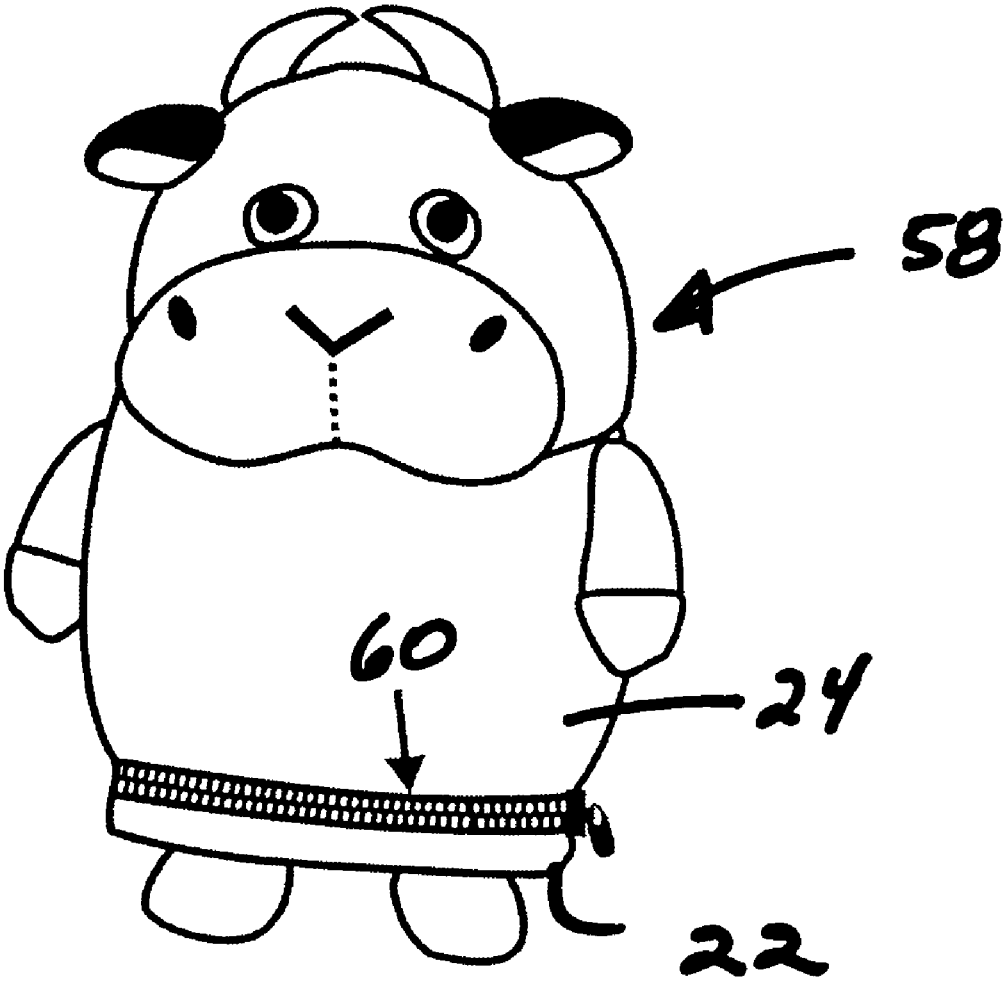
FIG. 6 is a similar view to FIG. 3 showing coupling means in the form of a slide fastener.

In the slipper 58 of FIG. 6, it will be seen that the foot covering 24 has been united with the sole 22 by means of a slide fastener 60 comprising complementary toothed portions each attached to respective portions of the heel portion and foot covering and a slide for engaging the complementary tooth portions, otherwise as a Zipper®.

Figure 7:
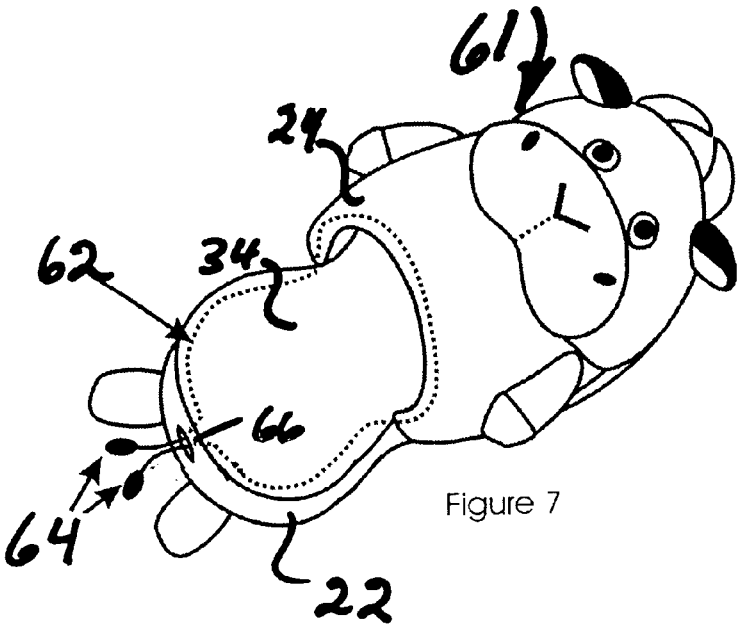
FIG. 7 is a similar view to FIG. 1 showing coupling means in the form of a drawstring.
Figure 8:
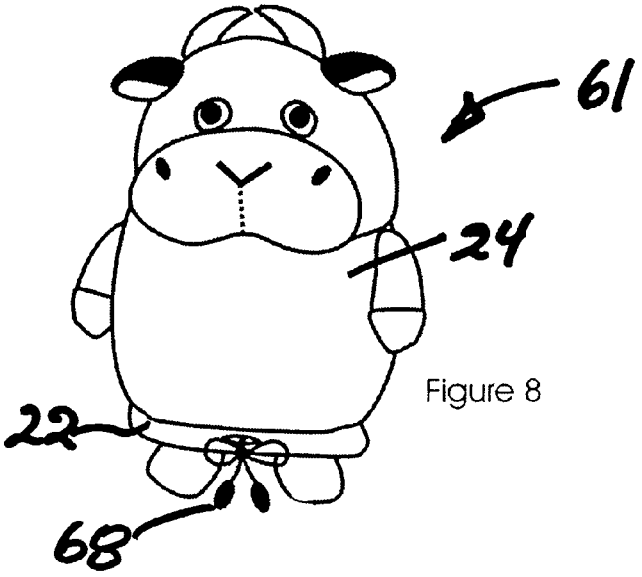
FIG. 8 is a front elevational view of the slipper of FIG. 7 in a transformed configuration.

In the embodiment of FIG. 7, the slipper 61 has a casing (not shown) stitched into marginal portions of the foot covering 24 and heel portion 34 through which a drawstring 62 is received as shown in dotted outline. Exposed ends of the drawstring 62 have beads 64 and are accessed through an opening 66 formed in the sole 22. By pulling on the beads 64, the drawstring 62 is exposed and the heel portion 34 is united with the foot covering 24. To maintain the united configuration, the draw string may be tied into a bow 68 as shown in FIG. 8.

Figure 9:
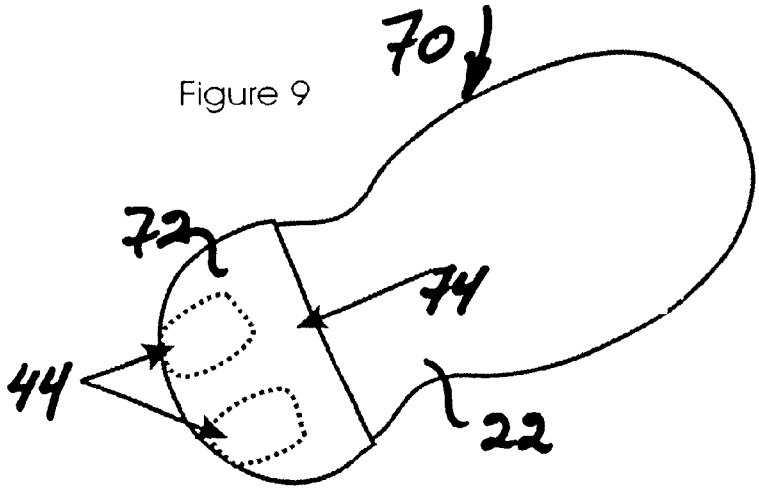
FIG. 9 is a back side elevation view of a slipper showing coupling means in the form of a pocket.
Figure 10:
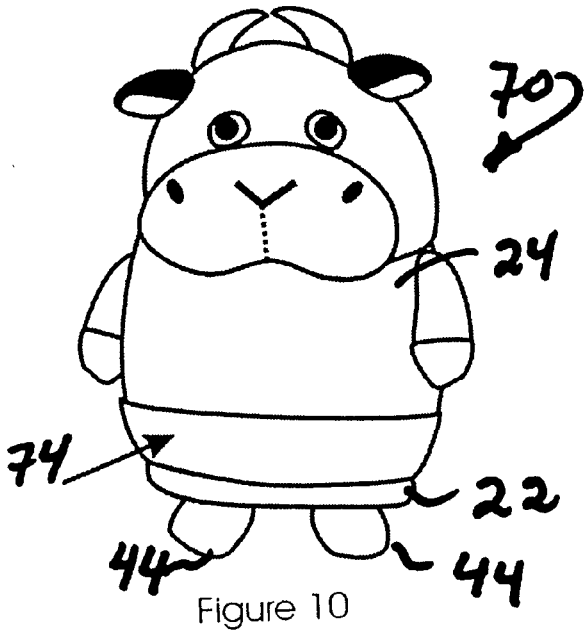
FIG. 10 is a front elevation view of the slipper of FIG. 9 in a transformed configuration.

Still another embodiment of a slipper 70 is shown in FIGS. 9 and 10. Here, the coupling means is in the form of a pocket 72 disposed on a bottom side of the sole 22 as shown in FIG. 9. The pocket 72 extends between marginal portions of the heel portion 34 and is open on one side as indicated by arrow 74. Because the sole 22 is made of pliable material, the pocket 72 is manipulatable and can be folded to the top side of the slipper 70 so as to receive the top portion of the sole 22. In this way, otherwise hidden foot appendages 44 become exposed. The pocket 72 has sufficient depths to bridge any separation between the sole 22 and the foot covering 24 as can be seen in FIG. 10. If desired, additional coupling means may be used to secure the pocket 72 to the foot covering 24.

Figure 11:
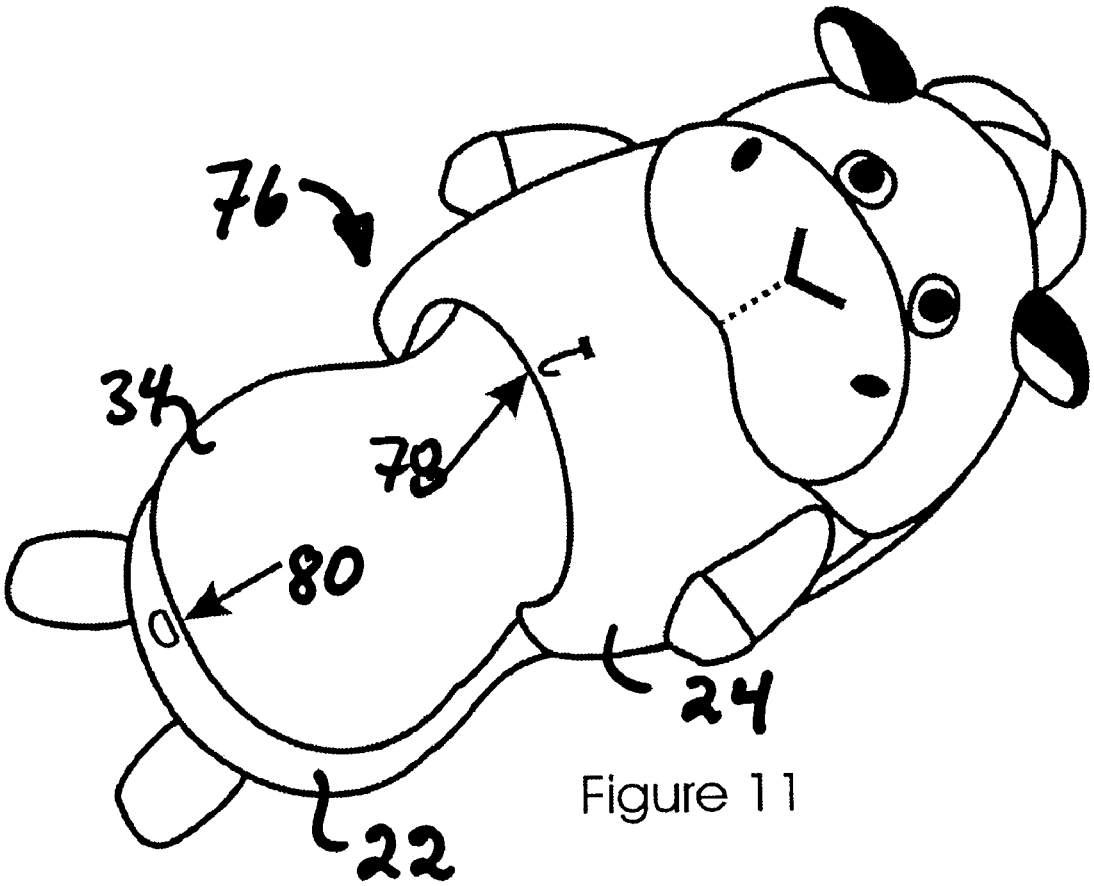
FIG. 11 is a similar view to FIG. 1 showing coupling means in the form of a hook and eye assembly.

Finally, in the embodiment of a slipper 76 shown in FIG. 11, the exposed heel portion 34 of the sole 22 is united with the foot covering 24 by means of a hook and eye assembly, the hook portion 78 being fixed to the foot covering 24 and the eye 80 being fixed to the sole 22 opposite from the hook 78.

It will be understood by those skilled in the art that many variations may be made to the above described embodiments of the invention within the scope of the appended claims and that the foregoing description is by way of example only.

What is claimed is:

1. A transformable slipper toy having a sole and a foot covering extending between marginal portions of the sole, the slipper having a first configuration in which a top portion of the sole is partially exposed in a heel portion to define a foot access to the slipper which is longitudinally spaced from the foot covering, the slipper having coupling means positioned on said heel portion and said foot covering for uniting said heel portion with the foot covering to close said foot access in a second configuration of the slipper.

2. Slipper toy according to claim 1 in which the foot covering carries decorative appendages for simulating a toy character.

3. Slipper toy according to claim 1 in which the coupling means includes complementary hook and loop fastener strips attached to respective portions of said heel portion and foot covering.

4. Slipper toy according to claim 1 in which the coupling means includes complementary un toothed portions attached to respective portions of said heel portion and foot covering, and a slide for engaging the complementary toothed portions.

5. Slipper toy according to claim 1 in which the coupling means includes at least one button and at least one respective button hole provided on respective portions of said heel portion and foot covering.

6. Slipper toy according to claim 1 in which the coupling means includes a snap fastener having complementary portions attached to respective portions of the heel portion and foot covering.

7. Slipper toy according to claim 1 in which the coupling means includes a hook and eye fastener assembly having complementary portions attached to respective portions of the heel portion and foot covering.

8. Slipper toy according to claim 1 in which the coupling means includes string.

9. Slipper toy according to claim 8 in which the heel portion and the foot covering each have a casing and a drawstring received in said casing, an opening for accessing said drawstring being provided in one said casing.

10. Slipper toy according to claim 1 in which the coupling means includes a pocket disposed on a bottom side oft he sole and extending between marginal portions of the heel portion in said first configuration of the slipper, the pocket being manipulatable to receive said top portion of the sole.

* * * * *